US008378945B2

(12) United States Patent
Harada

(10) Patent No.: US 8,378,945 B2
(45) Date of Patent: Feb. 19, 2013

(54) LIQUID CRYSTAL DISPLAY DEVICE

(75) Inventor: Kenji Harada, Ishikawa-ken (JP)

(73) Assignees: Kabushiki Kaisha Toshiba, Tokyo (JP); Japan Display Central Inc., Fukaya-shi (JP)

( * ) Notice: Subject to any disclaimer, the term of this patent is extended or adjusted under 35 U.S.C. 154(b) by 490 days.

(21) Appl. No.: 12/609,889

(22) Filed: Oct. 30, 2009

(65) Prior Publication Data

US 2010/0109990 A1 May 6, 2010

(30) Foreign Application Priority Data

Oct. 30, 2008 (JP) ..... P2008-279644

(51) Int. Cl.
*G09G 3/36* (2006.01)

(52) U.S. Cl. ..... 345/92

(58) Field of Classification Search ..... 345/87–104
See application file for complete search history.

(56) References Cited

U.S. PATENT DOCUMENTS

| | | | | |
|---|---|---|---|---|
| 6,774,876 | B2 * | 8/2004 | Inukai | 345/76 |
| 7,095,389 | B2 * | 8/2006 | Uehara et al. | 345/55 |
| 7,095,391 | B2 * | 8/2006 | Lee | 345/87 |
| 7,173,593 | B2 * | 2/2007 | Matsumura et al. | 345/98 |
| 7,209,131 | B2 * | 4/2007 | Matsumoto | 345/211 |
| 7,443,374 | B2 * | 10/2008 | Hudson | 345/98 |
| 2001/0005193 | A1 * | 6/2001 | Yokoyama | 345/92 |
| 2007/0002082 | A1 * | 1/2007 | Sakurai | 345/691 |
| 2007/0176875 | A1 * | 8/2007 | Kageyama et al. | 345/92 |
| 2009/0046080 | A1 * | 2/2009 | Hsueh et al. | 345/204 |

FOREIGN PATENT DOCUMENTS

| | | |
|---|---|---|
| JP | 2-272490 | 11/1990 |
| JP | 2000-347627 | 12/2000 |
| JP | 2002-91397 | 3/2002 |
| JP | 2006-343609 | 12/2006 |
| JP | 2007-199441 | 8/2007 |
| WO | WO 2007/007768 A1 | 1/2007 |

OTHER PUBLICATIONS

U.S. Appl. No. 12/625,808, filed Nov. 25, 2009, Harada.
U.S. Appl. No. 13/399,120, filed Feb. 17, 2012, Harada, et al.
Office Action issued May 10, 2011 in Japan Application No. 2008-279644 (English Translation).
U.S. Appl. No. 12/912,100, filed Oct. 26, 2010, Harada.

* cited by examiner

*Primary Examiner* — Chanh Nguyen
*Assistant Examiner* — Roy Rabindranath
(74) *Attorney, Agent, or Firm* — Oblon, Spivak, McClelland, Maier & Neustadt, L.L.P.

(57) ABSTRACT

A liquid crystal display device includes a pair of substrates, a plurality of pixels arranged in a matrix and a static memory formed on the substrates. A bit signal corresponding to an image data is written and held in a static memory in the pixel. The polarity of the input bit signal is controlled. A liquid crystal voltage supplied to a liquid crystal layer arranged between the pair of substrates is generated by the bit signal. The polarity of the bit signal is controlled to alternate the liquid crystal voltage, and a transmittance of the liquid crystal layer is changed by supplying the alternated liquid crystal voltage.

11 Claims, 10 Drawing Sheets

LIQUID CRYSTAL DISPLAY DEVICE

CROSS-REFERENCE TO RELATED APPLICATION

This application is based upon and claims the benefit of priority from prior Japanese Patent Application No. 2008-279644 filed Oct. 30, 2008, and the entire contents of which are incorporated herein by reference.

BACKGROUND OF THE INVENTION

1. Field of the Invention

The present invention relates to a liquid crystal display device including a pixel memory provided in each of LCD pixels to store an image data, and especially to control voltages applied to a pair of electrodes of respective pixels arranged in the liquid crystal display device.

2. Description of the Background Art

Liquid crystal display devices are widely used as typical display devices for various kinds of equipments such as personal computers, OA equipments, and TV sets because the display devices have many advantages such as lightness, compactness and low power consumption. In recent years, mobile liquid crystal display devices find use in mobile terminal equipments such as a mobile phone, a car navigation device and a game player, and a large size display panel has been in need. In order to meet such need, compactness, low power consumption or long time battery use have been requested.

A liquid crystal display device with a pixel memory in the LCD pixel is well-known as a display device to achieve low power consumption. In this type liquid crystal display device, a refresh operation is not required when a static image is displayed because a static memory is embedded in each pixel. Accordingly, power consumed by data lines or data driving circuits may be fully cut as shown, for example, in Japanese Patent Application 2007-199441.

FIG. 12 of the Japanese Patent Application illustrates a circuit diagram, in which a drain electrode of a first transistor 15 is connected to an input terminal a1 to set a memory state of the static memory. A drain electrode of a second transistor 18 is connected to the input terminal az1 to reset the memory state, and a source electrode of the first transistor 15 is connected to a data line S1. Gate electrodes of the first and second transistors formed in the pixels arranged in parallel with gate lines are connected to corresponding gate lines, respectively. In the pixels arranged in a row direction, for example, the gate electrodes of the first and second transistors 15 and 18 are connected to a pair of gate lines G1 and G0, respectively.

The circuit diagram shown in FIG. 12 has following problems. The voltages VLCa and VLCb are periodically inverted. Since the voltages VLCa and VLCb are connected to a total liquid crystal capacitance of all the pixels in the display area, it is necessary to design driving circuits such as output buffers for voltages VLCa and VLCb so that a driving ability of output buffers is sufficiently high to enable voltages applied to the liquid crystal capacitance of all pixels invert simultaneously, which results in an increase in power consumption of the driver circuits.

Furthermore, when the driving circuits for the voltages VLCa and VLCb are formed in the array substrate using the same process as the pixels, the circuit size of the driving circuits becomes large and a large layout space is required, which may result in an enlargement of a frame size and further a lowering of a product value.

Moreover, the voltages VLCa and VLCb are supplied to the liquid crystal capacitance through N channel type transistors. In such a case, if a gate voltage VDD to make the N channel transistor conductive is the same level as that of high level "H" of the voltages VLCa and VLCb, a voltage level reduced by the threshold voltage Vth of the N channel type transistor from the "H" level is applied to the liquid crystal capacitance. Therefore, a decreased contrast or a flicker phenomenon may occur due to a voltage shift between a pixel voltage and a common voltage supplied to the liquid crystal layer.

In a moving image display, it is necessary to store different signals successively in the pixels while driving the liquid crystal layer by AC operation in the Japanese Application. Accordingly, an inversion operation of a polarity of voltage to maintain pixel signals is required, that is, a polarity of a data signal is inverted corresponding to inversion of a polarity of the frame (common voltage). Otherwise, power consumption of a driver circuit for data lines may be increased.

Moreover, in this technology, a problem is noted that a current to maintain a pixel signal is not easily discharged when a power becomes on or off and an abrupt power failure occurred, which may result in generation of a display time lag.

BRIEF SUMMARY OF THE INVENTION

The present invention has been made to address the above mentioned problems. One object of the present invention is to provide a liquid crystal display device with a static memory in each pixel to achieve low power consumption and a high quality display.

Thus, according to one aspect of the invention, there is provided a liquid crystal display device, including a pair of substrates including electrodes formed on respective substrates; a liquid crystal layer interposed between the pair of substrates; a plurality of pixels arranged in a matrix on the substrates; signal lines arranged in a column direction and each of signal lines connected to the pixels arranged in the column direction to supply bit signals corresponding to an image signal; control lines arranged in a row direction, the control lines selecting pixels arranged in the row direction to supply a plurality of control signals to write and hold the bit signals corresponding to the image signal to the selected pixels; a static memory provided to each pixel to hold the bit signals; each pixel including a switch element to take in the bit signals corresponding to the image signal to the static memory, a polarity control circuit to control the held bit signals and a driving voltage generator to supply voltages generated by the bit signals to the liquid crystal layer, wherein the transmittance of the liquid crystal layer is changed corresponding to the bit signals.

According to another aspect of the invention, there is provided a method for controlling the liquid crystal display device including a pair of substrates, a liquid crystal layer held therebetween, a plurality of pixels arranged in a matrix and a static memory formed on the substrates, including steps of writing and holding a bit signal corresponding to an image data in the static memory in the pixel; controlling the polarity of the input bit signal; generating a liquid crystal voltage supplied to the liquid crystal layer by the bit signal, the polarity of the bit signal controlled to alternate the liquid crystal voltage; and changing a transmittance of the liquid crystal layer by supplying the alternated liquid crystal voltage.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
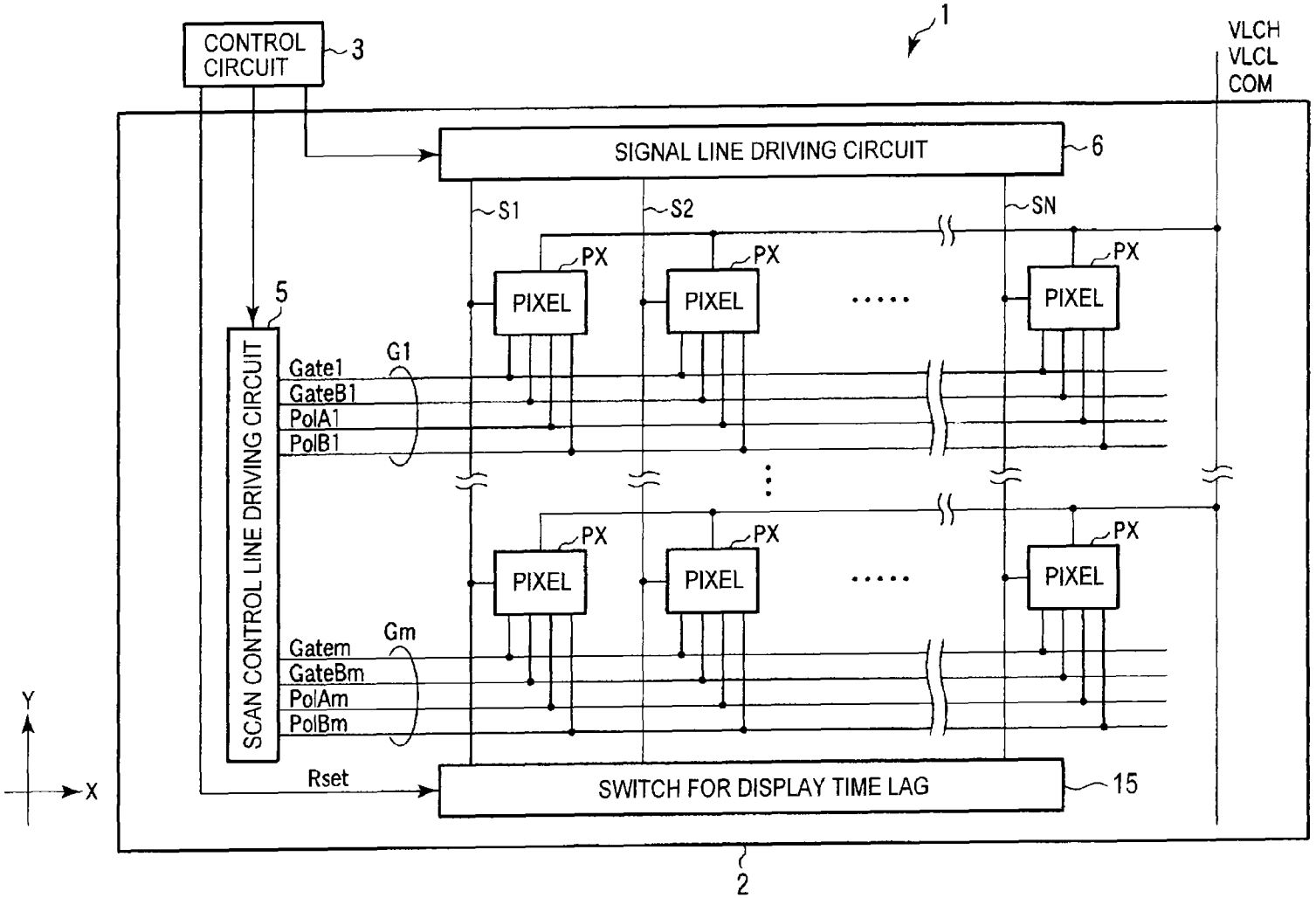
FIG. 1 is a schematic circuit diagram showing a liquid crystal device according to a first embodiment of the invention.

A liquid crystal display device according to an exemplary embodiment of the present invention, in particular, a liquid crystal display device having a pixel memory will now be described with reference to the accompanying drawings wherein the same or like reference numerals designate the same or corresponding parts throughout the several views. According to the present invention, a pixel memory built-in type liquid crystal display device is provided, in which power consumption is decreased and a high quality display device is achieved.

Hereinafter, a liquid crystal display device according to a first embodiment will be explained referring to figures. As shown in FIG. 1, the liquid crystal display device includes a display panel 1 and a control circuit 3 to control the display panel 1. The liquid crystal display panel 1 is formed of a pair of substrates, an array substrate 2 and a counter substrate (not shown) and a liquid crystal layer interposed therebetween. The display panel 1 includes (m×n) pixels PX arranged in a matrix on the array substrate 1 formed of a transmissive insulating substrate such as a glass substrate. The display panel 1 also includes first to mth scan control lines G1, . . . Gm composed of independently arranged 4 control lines and connected to the pixels arranged in a row direction. Each of the scan control lines G includes four control lines Gate, GateB, PolA and PolB to control the operation of the pixels PX.

The control circuit 3 controls a transmittance of the display panel 1 by a liquid crystal driving voltage supplied between the substrates of the pixel PX. A reset signal Rset is supplied to a switch to prevent a display time lag through a reset line Rset. Signal lines, S1, S2, . . . SN connected to the pixels extending in a column direction (Y direction) as shown in FIG. 1 are connected to a signal line driving circuit 6. The scan control lines G1~Gm connected to the pixels arranged in the row direction lines are connected to a scan control line driving circuit 5.

The scan control line driving circuit 5 and the signal line driving circuit 6 are driven by timing pulses supplied by the control circuit 3. The timing pulses and clock signals in synchronized with image signals are supplied to input terminals (not shown) of control circuit 3. Accordingly, the control circuit 3 can provide various timing pulses in synchronized with image signals to the scan control line driving circuit 5 and the signal line driving circuit 6. Power lines are connected to each pixel PX to supply electric power. Similarly, the power lines are also connected to the scan control line driving circuit 5, the signal line driving circuit 6 and the control circuit 3. The scan line control driving circuit 5, the signal line driving circuit 6 and the control circuit 3 may be formed on the array substrate 2 or may be formed in one IC outside of the array substrate 2.

Figure 2:
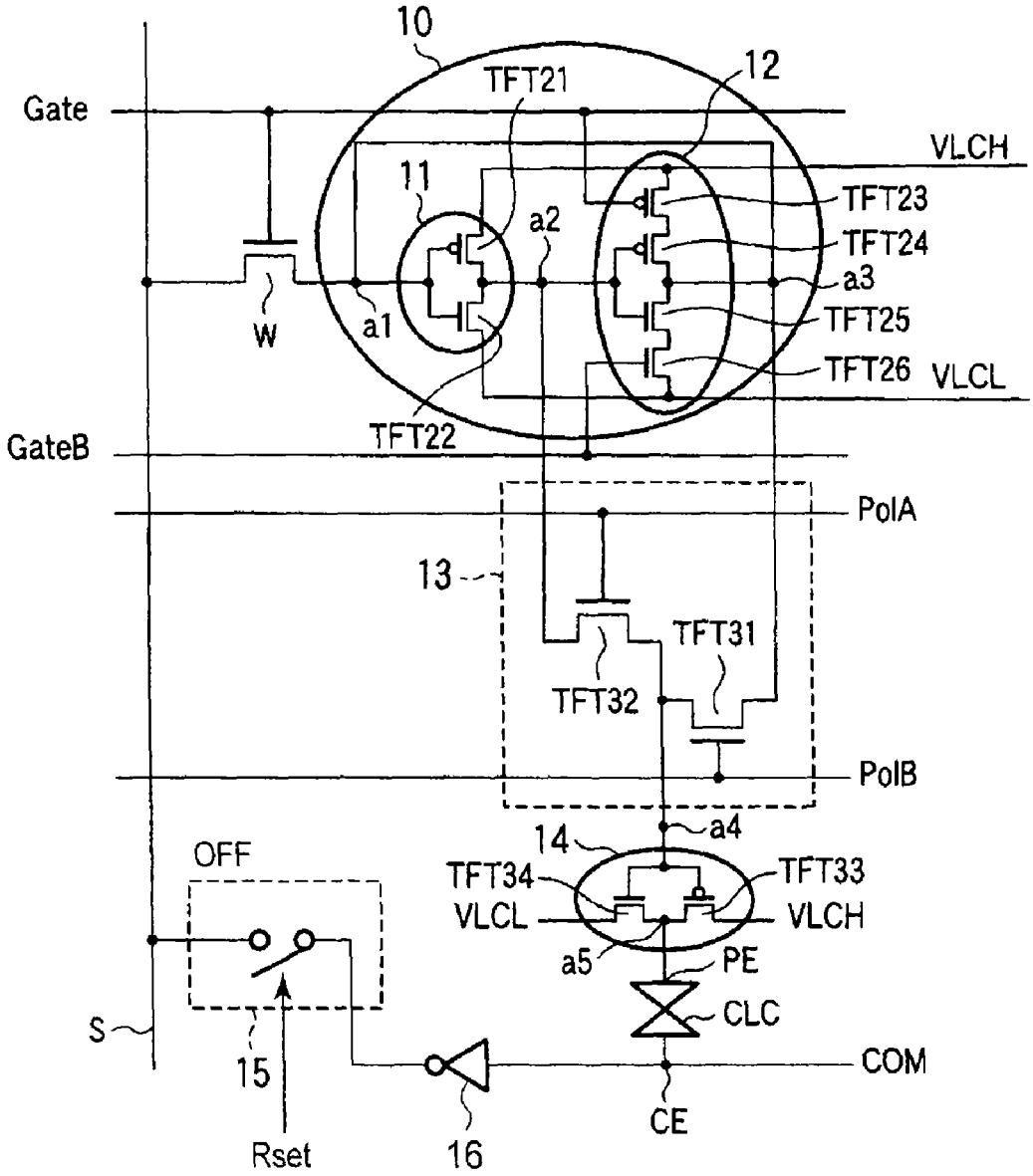
FIG. 2 is a schematic circuit diagram showing a pixel of the liquid crystal device according to the first embodiment of the invention.

FIG. 2 shows a structure of each liquid crystal pixel PX. The pixel PX includes a switching element W, first inverter circuit 11, a clocked inverter circuit 12, a polarity inversion switch circuit 13, a second inverter circuit 14 and a liquid crystal capacitance CLC. A static memory circuit (SRAM circuit) 10 is constructed by the first inverter circuit 11 and the clocked inverter circuit 12. In FIG. 2, a connection of a switch 15 to prevent a display time lag is shown to explain an operation of the liquid crystal display panel. The switching element W is formed of a Thin Film Transistor (TFT), in which a gate electrode is connected to the control line Gate and a source to drain path is connected between the signal line S and an input node a1 of the first inverter circuit 11. Accordingly, the corresponding signal line S and the input node a1 are connected when the switching transistor W becomes conductive. The first inverter circuit 11 is constructed by TFT 21 and TFT 22 in which an input terminal of the first inverter circuit 11 is connected to the input node a1 and the output terminal is connected the output node a2. Gate electrodes of the TFT21 and TFT22 are commonly connected to the node a1, and the drain electrodes of the TFT21 and the TFT22 are commonly connected to the node a2. Respective power lines are connected to supply a high voltage VLCH to a source electrode of the TFT21 and to supply a low voltage VLCL to a source electrode of the TFT22.

The clocked inverter circuit 12 is formed of four transistors TFT23, TFT24, TFT25 and TFT26. Gate electrodes of the TFT24 and TFT25 are commonly connected with the node a2 as an input terminal and drain electrodes of the TFT24 and TFT25 are commonly connected with a terminal a3 as an output terminal. TFT23 and TFT26 are connected to the TFT24 and the TFT25, respectively. Respective power lines are connected to a source electrode of TFT23 to supply a high voltage VLCH and a source electrode of TFT26 to supply a low voltage VLCL. Furthermore, the gate electrode of the TFT23 is connected to the control line Gate and the gate electrode of TFT26 is connected to the control line GateB.

The SRAM circuit 10 is constructed by the first inverter circuit 11 and the clocked inverter circuit 12, and the node a1 and the node a2 are connected. The polarity inversion switch circuit 13 is formed of TFT31 and TFT32 so that the nodes a2 and a3 are input terminals and a node a4 is an output terminal of the polarity inversion switch circuit 13. A gate electrode of the TFT31 is connected to a polarity control line PolB and a source to drain path is connected between the nodes a3 and a4. A gate electrode of the TFT32 is connected to a polarity control line PolA and a source to drain path of TFT32 is connected between the nodes a2 and a4.

The second inverter circuit 14 is formed of TFT33 and TFT34 so that the node a4 is an input terminal and the node a5 is an output terminal. The gate electrodes of the TFT33 and TFT34 are commonly connected to the node a4 and drain electrodes are also commonly connected to an output node a5. Respective power lines are connected to source electrodes of the TFT33 and TFT34 to supply the high voltage VLCH and the low voltage VLCL. The output node a5 of the second inverter circuit 14 is connected to a pixel electrode PE and a common electrode CE of the other side of the liquid crystal layer is connected to a common line COM. The common line COM is connected to the signal line S through a switch circuit 15. The switch circuit 15 controls a switching operation by a reset signal Rset supplied through a reset line Rset.

Figure 3:
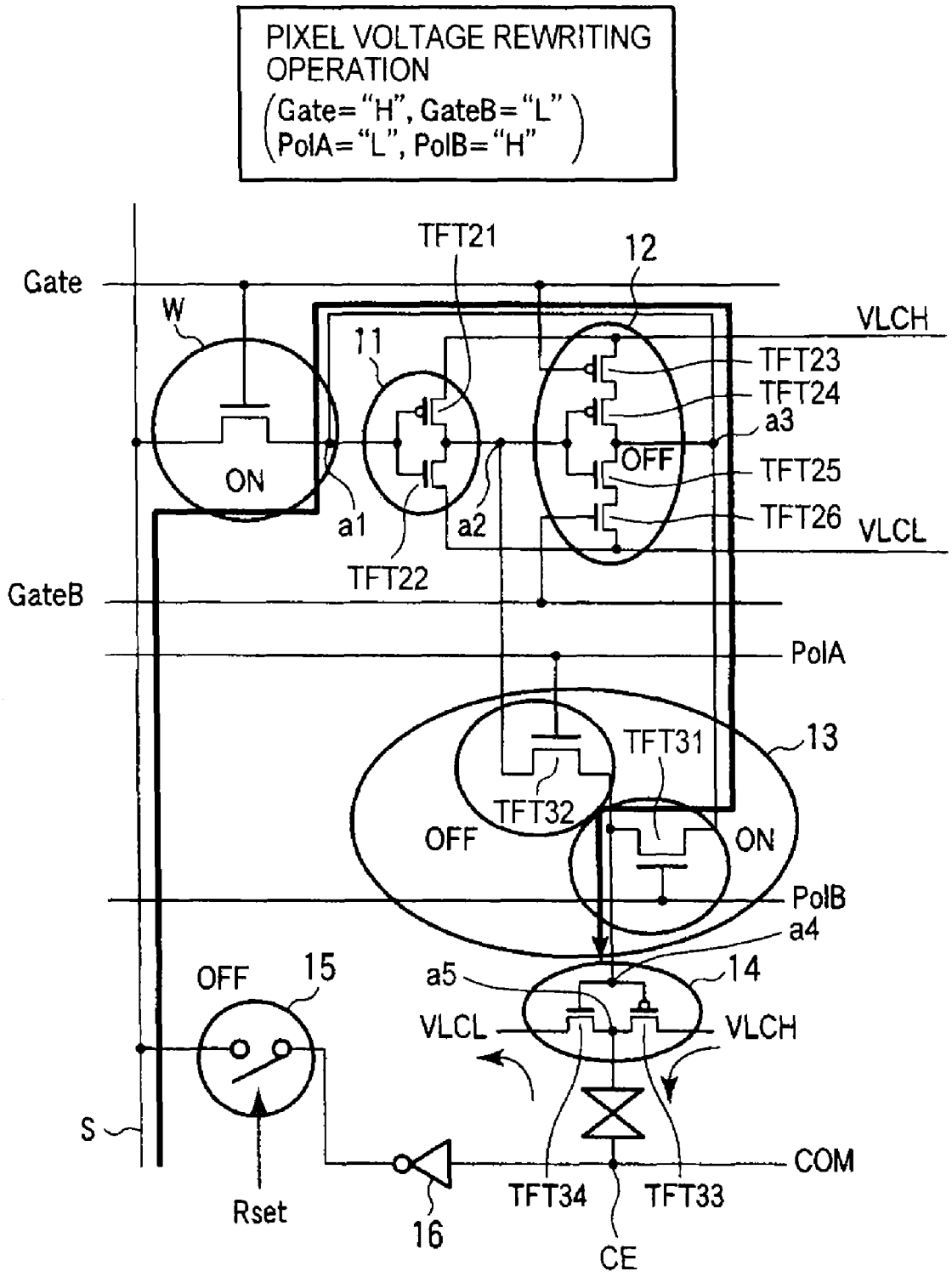
FIG. 3 is a schematic circuit diagram for explaining a write-in operation of a pixel voltage into a pixel according to the first embodiment of the invention.

Next, an operation of the pixels will be explained. FIG. 3 is a circuit diagram to explain an operation of rewriting the pixel voltage. This operation is to apply "1" bit information, that is, "H level (VLCH)" and "L level (VLCL)" to the liquid crystal layer. During this operation, the levels of the control lines are follows. The control line Gate is "H" level, the control line GateB is "L" level, the control line PolA is "L" level, the control line PolB is "H" level and the switch circuit SW is off state.

[When the Signal Line S is "H"]

When the level of the control line Gate becomes "H" level, the switching transistor W becomes conductive, and "H" level is supplied to an input terminal, that is, the node a1 of the first inverter circuit 11. Consequently, the voltage of the node a2 becomes VLCL. However, the clocked inverter circuit 12 is "off" state because the level of the control line Gate is "H" level and the level of the control line GateB is "L" level. Therefore, the potential "H" of the signal line S is applied to the node a3 through a route shown by the arrow.

In the polarity inversion switch circuit 13, since the control line PolA is "L" level and the control line PolB is "H" level, the TFT32 is in the "OFF" state and the TFT31 is in the "ON" state.

Accordingly, the potential of the node a4 becomes "H" level, that is, the level of the node a3. Consequently, in the second inverter circuit 14, the TFT34 becomes conductive and the voltage VLCL is applied to the pixel electrode PE.

[When the Signal Line S is "L" Level]

A low level "L" of the signal line S is transmitted to the node a4, that is, the level of the node a3 through the same route as above. Consequently, in the second inverter circuit 14, the TFT33 becomes conductive and the voltage VLCH is applied to the pixel electrode PE.

Figure 4:
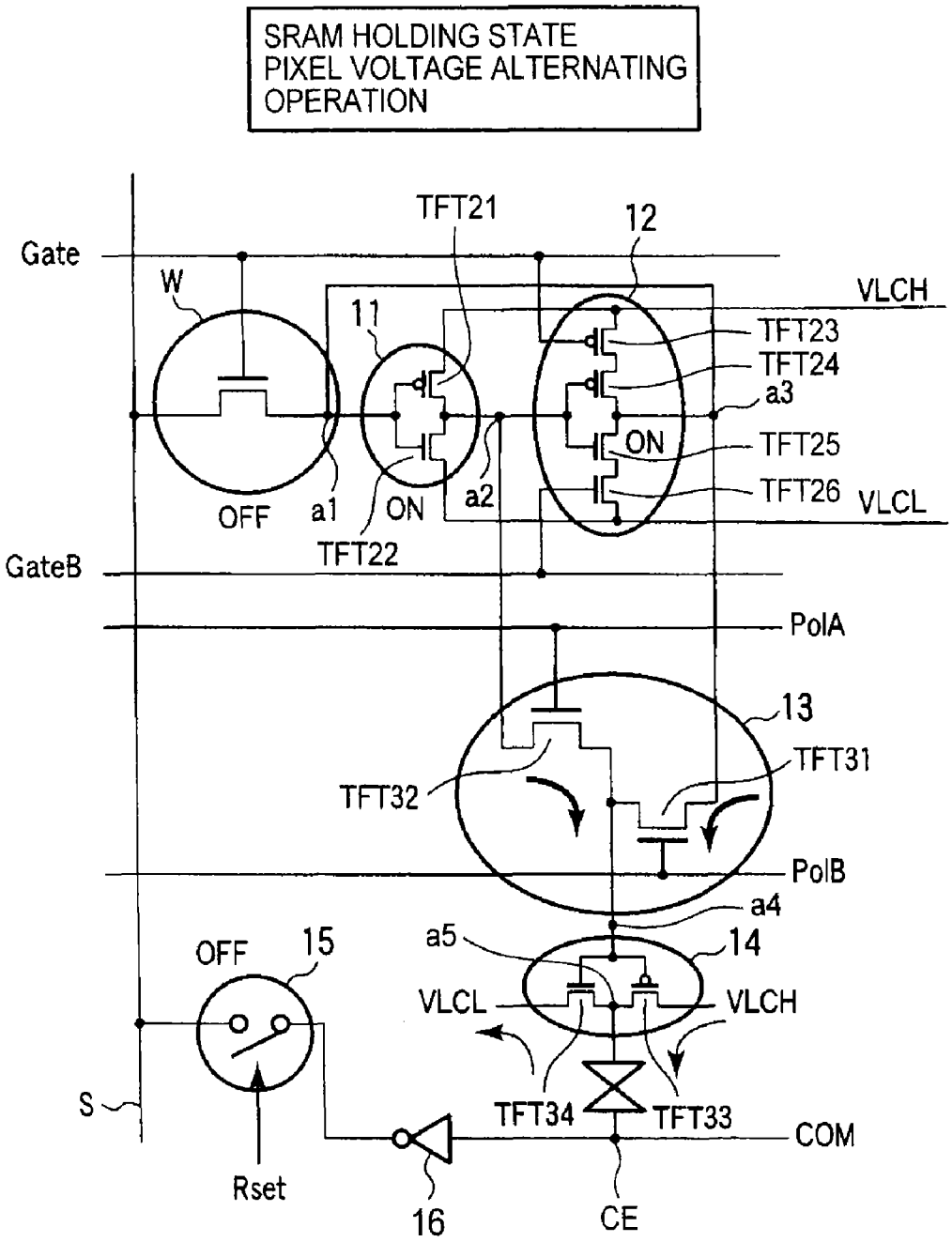
FIG. 4 is a schematic circuit diagram for explaining a holding operation of pixel voltage in a SRAM and an AC voltage generating operation of the pixel voltage according to the first embodiment of the invention.

FIG. 4 is a circuit diagram to explain to hold a pixel voltage in the SRAM and to generate AC voltage applied to the liquid crystal layer. In this operation time, the level of the control line Gate is "L" level, the level of the control line GateB is "H" level opposite to that of the control line Gate and the switching SW is in the "OFF" state by the control circuit 3.

(1) when the voltage of the signal line S is "H" level in the rewriting operation of the pixel voltage:

The levels of the nodes a1 and a3 are "H" levels and the level of node a2 is VLCL. Since the control line Gate is "L" level and the switching element W becomes "OFF" state. However, the clocked inverter circuit 12 becomes "ON" state because the level of the control line GateB is "H" level and the voltage of the node a3 becomes "VLCH". The voltage of the node a1 also becomes the same as that of the node a3. Accordingly, the SRAM circuit 10 holds the state at the rewriting mode.

When the level of the control line PolA is "L" level and the level of the control line PolB is "H" level, the TFT31 is in the "ON" state and the TFT32 is in the "OFF" state. Therefore, the voltage of the polarity inversion switch 13 becomes "VLCH" and the TFT34 of the inverter circuit 13 becomes "ON" state. Finally, a voltage VLCL is applied to the pixel electrode PE.

On the other hand, when the level of the control line PolA is "H" level and the level of the control line PolB is "L" level, the TFT31 is in the "OFF" state and TFT32 is in the "ON" state. Therefore, the voltage of the polarity inversion switching circuit 13 becomes "VLCL" and the TFT33 of the second inverter circuit 14 becomes "ON" state. Finally, a voltage VLCH is applied to the pixel electrode PE.

As described above, it becomes possible to generate an AC voltage applied to the liquid crystal layer by changing the polarities of the control lines PolA and PolB alternately.

(2) When the Signal Line S is "L" Level:

The voltage of the node a2 is held at VLCH and the voltage of the node a1 is held at VLCL. In this case, it is possible to alternate the voltage supplied to the liquid crystal layer by alternately changing the polarities of the control lines PolA and PolB.

Figure 5:
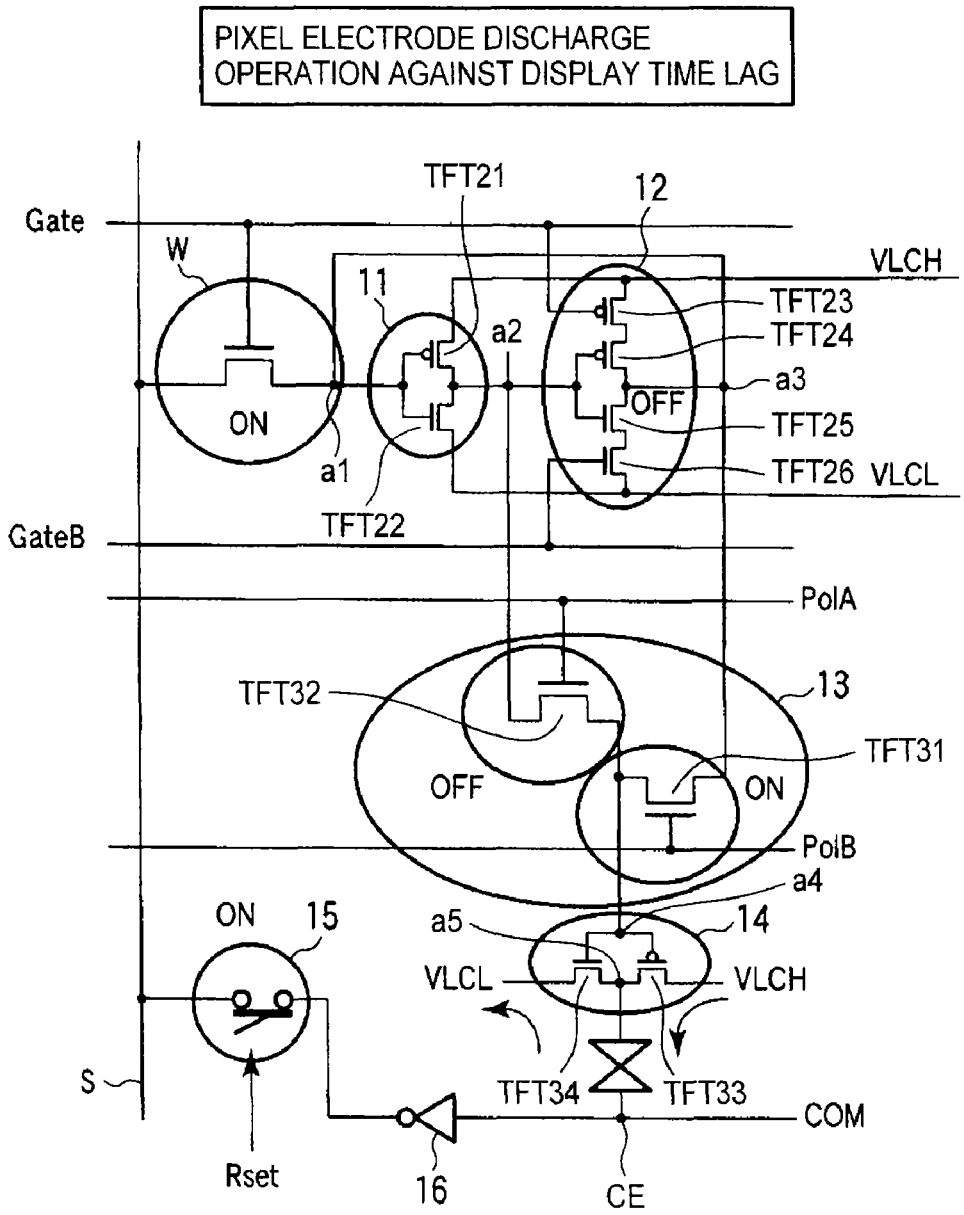
FIG. 5 is a schematic circuit diagram for explaining a discharging operation of the pixel voltage according to the first embodiment of the invention.

FIG. 5 is a circuit diagram to explain a discharge operation of the pixel electrode. When the power becomes on state, off state or breaks down, the control circuit 3 compulsory sets the control line Gate at "H" level, the control line GateB at "L" level, the control line PolA at "L" level and PolB at "H" level and a reset signal Rset becomes "ON" state for all the pixels. In this condition, the switch 15 to prevent a display time lag is in the "ON" state and the common voltage of "L" state is inverted by an inverter circuit 16. The inverted common voltage "H" is supplied to the signal line S. The condition of the pixel PX is the same as that of the rewriting operation as shown in FIG. 3. Accordingly, the voltage of the signal line S is inverted by the second inverter circuit 14 and the same voltage as the common line is supplied to the pixel electrode PE.

Accordingly, it is possible to reset the charges stored in the pixel electrode. For example, if the pixel electrode is not reset even at the time when the power becomes off, the stored charges are discharged at naturally discharging speed. In this case, since a discharge constant is different from each pixel, a display time lag with a display uniformity may be generated after the power becomes off. The detection of the power on, off or power break is conducted by watching the power condition or an operating switch. Here, the abrupt power break is supposed to be cases where a battery or a battery pack is taken up from a mobile phone, a digital camera or a digital recorder without conducting a switching operation.

Figure 6:
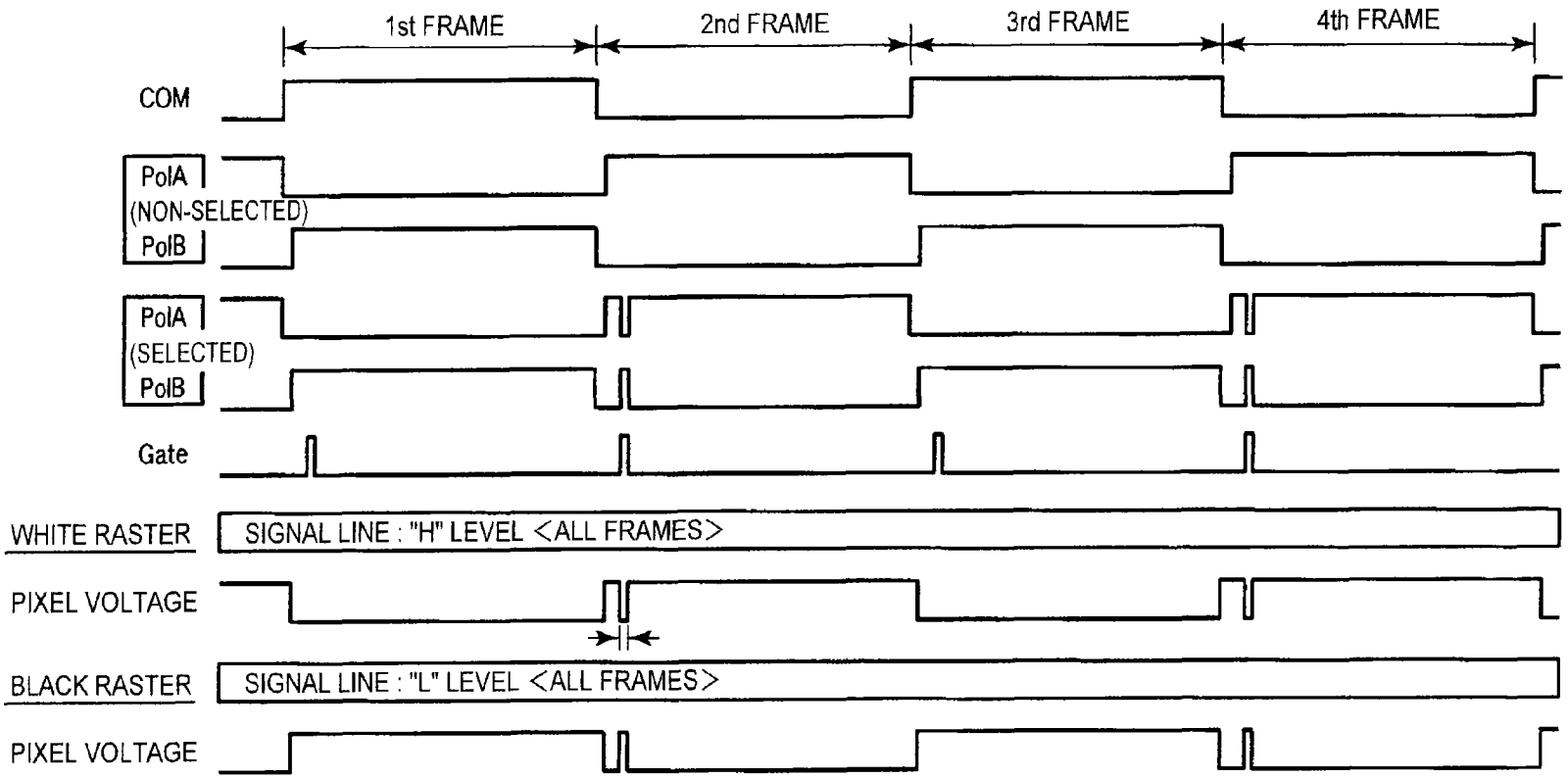
FIG. 6 is a timing chart showing a driving timing of each voltages when the pixel voltage is rewritten according to the first embodiment of the invention.

FIG. 6 is a timing chart to show a driving time of each voltage of the control lines when the pixels are rewritten. In the liquid crystal pixel PX, it is necessary to alternate the voltage applied to the liquid crystal layer because, if a constant voltage with a same polarity is continuously applied, a display defect may be caused by an ionization of the liquid crystal layer.

In the embodiment shown in FIG. 6, the common voltage COM is inverted every 1 frame, and the voltages "H" and "L" are replaced on the control lines of PolA and PolA. When the pixel voltage is rewritten in the first frame, the control circuit 3 sets the voltage of control line Gate at "H" level, the voltage of control line GateB at "L" level, the voltage of the control line PolA at "L" level, the voltage of the control line PolB at "H" level, and also sets the switch 15 to the "OFF" state. In this condition, the voltage level of the control line Gate changes from "L"→"H"→"L" level in a short pulse. In the first frame, since the voltage of the control line PolA is at "L" level and the voltage of the control line PolB is at "H" level, that is, in the rewriting mode shown in FIG. 3, the voltage of the pixel PX is rewritten corresponding to the voltage of the signal line S at the timing when the control line Gate is "H" level.

In a normally black liquid crystal display, it is not required to alternate the signal line S, that is, the voltages of the signal line S may be any time "H" level in a white raster display and the voltages of the signal line S may be any time "L" level in a black raster display. The pixel voltage becomes "L" level in the white raster display and the pixel voltage becomes "H" level in the black raster display.

In a second frame, when the pixel voltage is rewritten, the voltage level of the control line Gate changes from "L"→"H"→"L" level in a short pulse. In the second frame, since the voltage of the control line PolA is at "H" level and the voltage of the control line PolB is at "L" level in pulses, the voltage of the control line PolA changes to "L" level and the voltage of the control line PolB changes to "H" level, that is, in the rewriting mode shown in FIG. 3, the voltage of a pixel PX is rewritten corresponding to the voltage of the signal line S in the timing when the control line Gate is "H" level. The pixel voltage returns to an original voltage in synchronised with the return of the levels of the control lines PolA and PolB to "H" and "L" levels, respectively. Since the time taken in the writing operation is very short compared with one frame time (1V), the writing time has little effect on the alternation operation of the voltages supplied to the liquid crystal layer.

Figure 7:
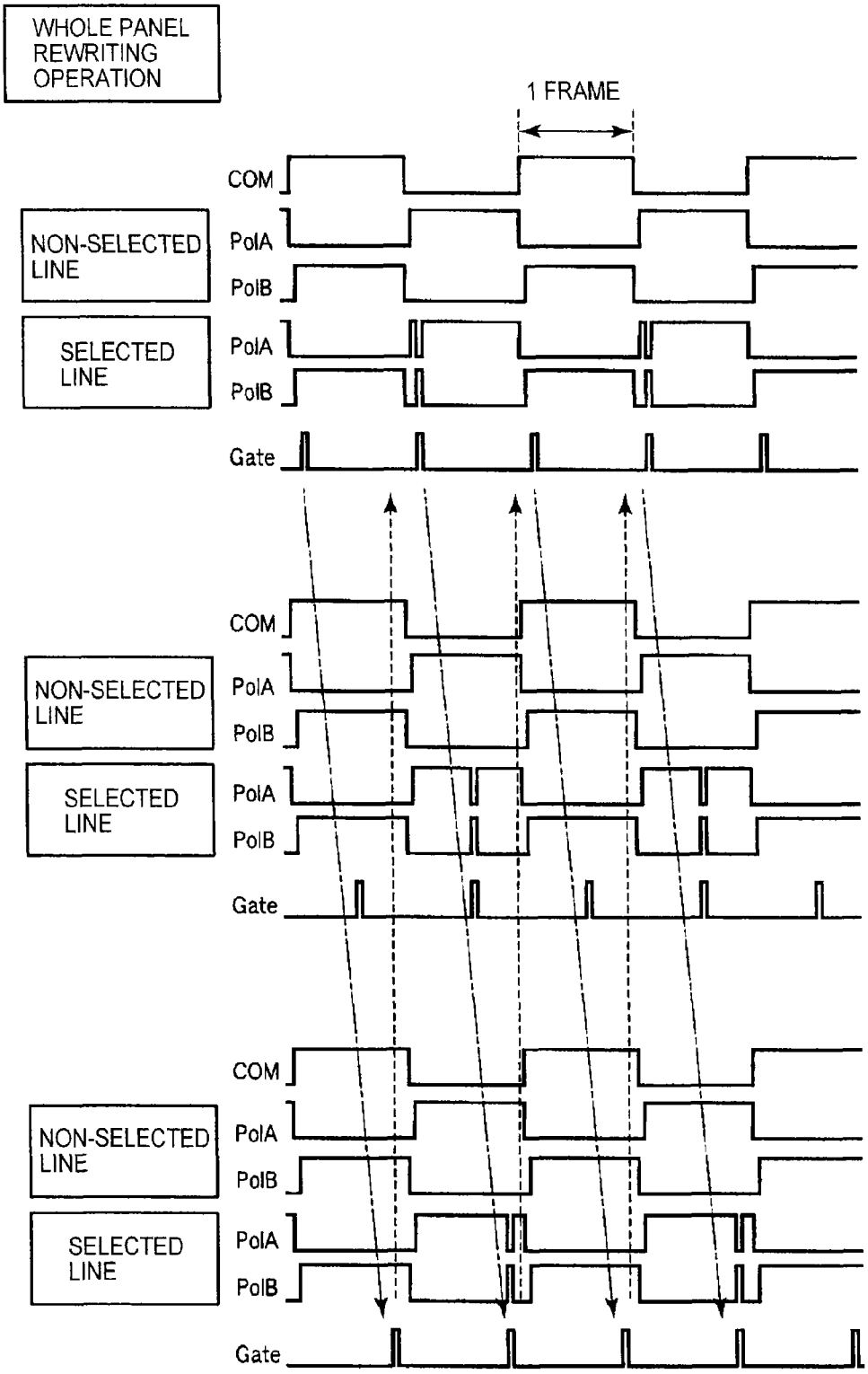
FIG. 7 is a timing chart showing a driving timing of respective voltages of control lines when the pixel voltage of all the pixels is rewritten according to the first embodiment of the invention.

FIG. 7 is a timing chart to show a driving timing to rewrite all the pixels. The scan control line driving circuit 5 sequentially selects the scan control lines G1~Gm and sets the corresponding control lines Gate, GateB, PolA and PolB at predetermined voltages. In this embodiment, the scan control lines G1~Gm are selected sequentially in a vertical direction. Accordingly, the location of the pulse of the control line Gate shifts in the row direction.

Figure 8:
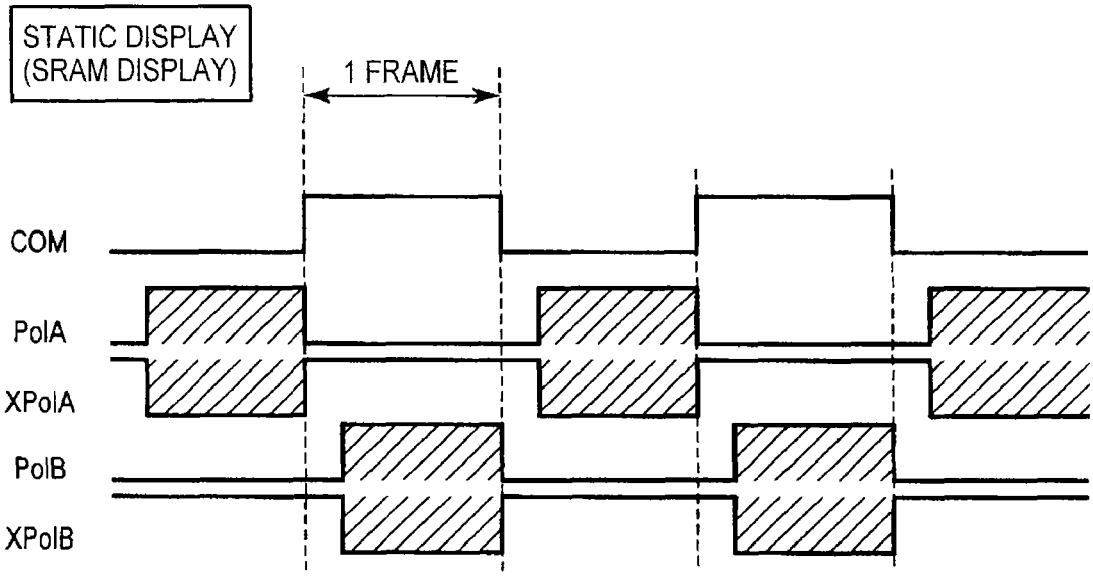
FIG. 8 is a timing chart showing a driving timing of respective voltages of the control lines in each pixel PX when a static image is displayed according to the first embodiment of the invention.

FIG. 8 is a timing chart to show a driving timing of respective control lines to show a static image in each pixel. Since, the liquid crystal display device includes a SRAM circuit 10, it is not required to refresh the pixel voltage in every frame. The alternation operation of the voltages supplied to the liquid crystal layer is conducted by switching the voltages of the control lines PolA and PolB alternately. In this embodiment, the control signals XPolA and XpolB are inverted signals of the control signals PolA and PolB and used in a circuit that is explained later. The signal PolB rises up after the signal PolA falls with a predetermined time lag, or similarly, the signal PolA rises up after the signal PolB falls with a predetermined time lag. This is to prevent a compete operation in which the both signals become simultaneously "H" level.

Figure 9:
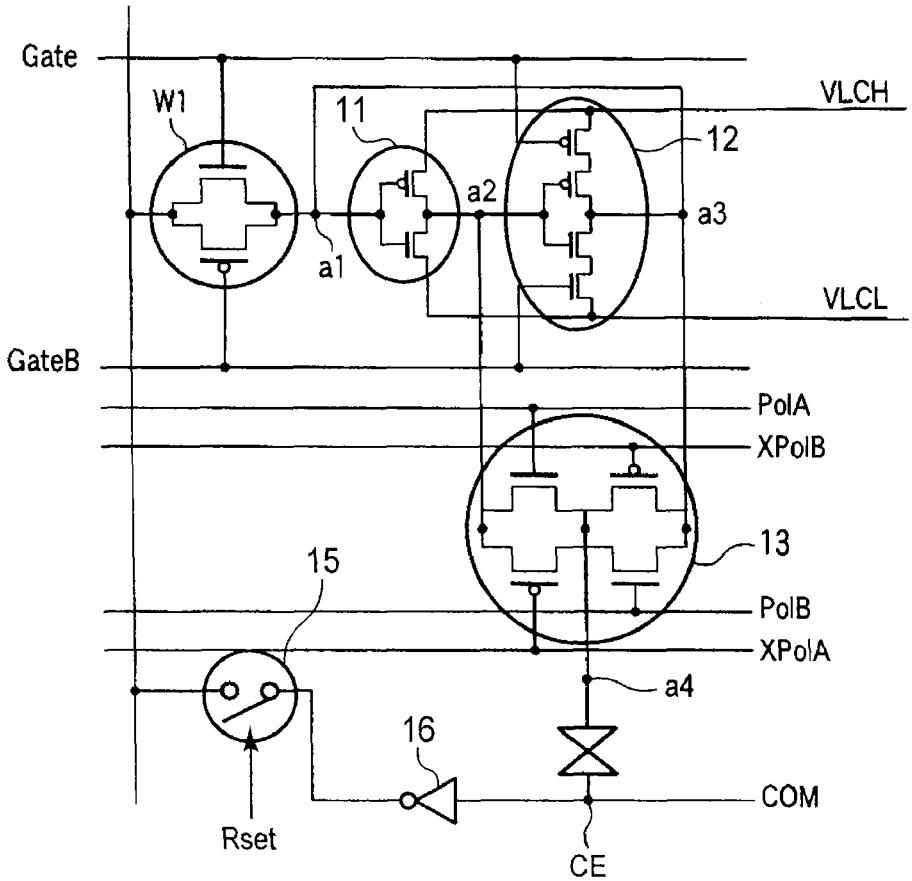
FIG. 9 is a schematic circuit diagram showing a pixel according to a second embodiment of the invention.

FIG. 9 is a circuit diagram of a pixel showing a second embodiment according to the present invention. In this embodiment, the switching transistor W1 is formed of a pair of N channel and P channel transistors. In the first embodiment, when a signal "H" level is supplied to the input terminal of the switching transistor W, a voltage less than a threshold voltage ("H"-Vth) is output to the node a1. On the contrary, in the second embodiment, the P channel transistor compensates for a reduction of the threshold voltage Vth, and an "H" level without reduction by an amount of the threshold voltage Vth can be supplied to the node a1.

The TFTs composing the polarity inversion switch circuit 13 are formed of a transfer gate circuit. Accordingly, the inversion switching circuit 13 can output "H" and "L" levels without being affected by the threshold voltage Vth of the transistor. The second inverter circuit can be eliminated and it becomes possible to directly supply the output of the inversion switching circuit 13 to the pixel electrode PE without interposing the second inverter circuit.

Figure 10:
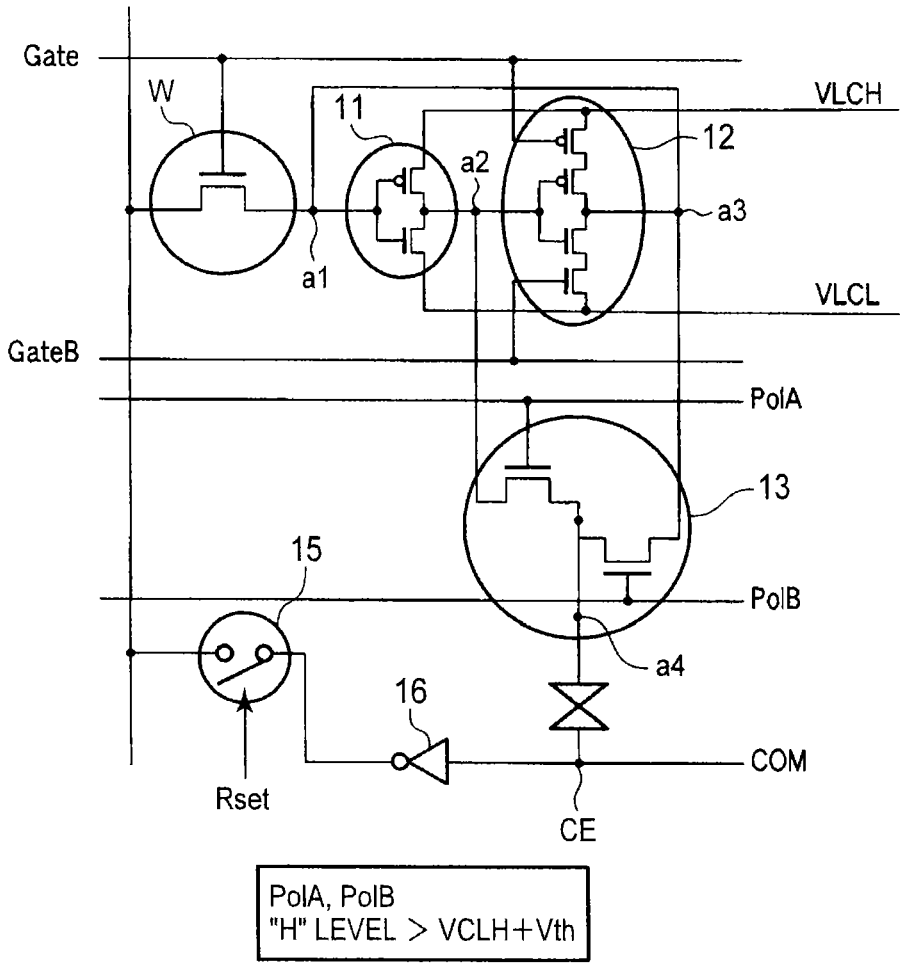
FIG. 10 is a schematic circuit diagram showing a pixel according to a third embodiment of the invention.

FIG. 10 is a circuit diagram showing a third embodiment of a liquid crystal pixel PX, in which the second inverter circuit 14 is not provided. The purpose of the second inverter circuit 14 is to avoid the influence of the threshold voltage in the first embodiment. In this third embodiment, the influence of the threshold voltage Vth is avoided by setting the "H" level of the signals PolA and PolB so that the "H" level is sufficiently higher than VLCH+Vth. Instead, it is also possible to avoid the influence of the threshold voltage Vth by shifting the voltage of the common voltage COM, for example, toward a lower voltage of the threshold voltage.

Accordingly, the second inverter circuit may be eliminated and it becomes possible to directly supply the output of the inversion switching circuit 13 to the pixel electrode PE without interposing a second inverter circuit 14.

Figure 11:
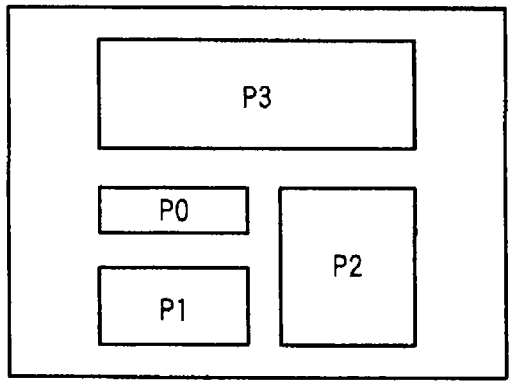
FIG. 11 is a diagram showing a construction of a pixel according to a fourth embodiment
Figure 12:
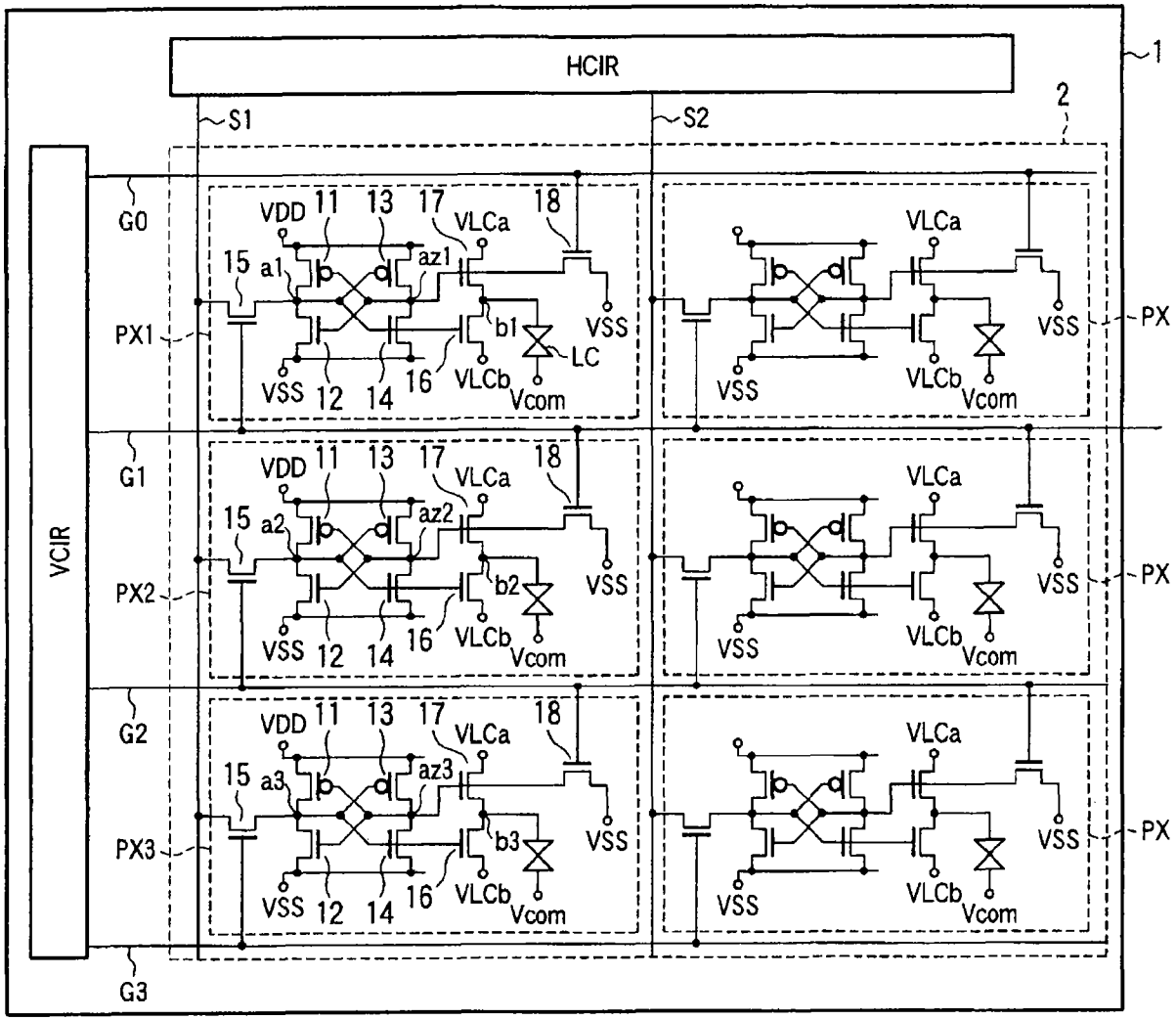
FIG. 12 PRIOR ART
FIG. 12 is a circuit diagram showing a conventional liquid crystal device.

FIG. 11 shows a fourth embodiment according to the present invention, in which a digital gradation display system using an area coverage modulation method of displaying multiple gray levels is adopted. In the digital gradation display system, one pixel electrode PE is divided into a plurality of sub-pixel electrodes and respective areas of the sub-pixels are different from each other. One or some sub-pixel electrodes in the selected one pixel are selected to get a display area in one pixel by combining the sub-pixels. Accordingly, the display area in the selected pixel may be changed digitally.

FIG. 11 is a diagram showing respective size of sub-pixel electrodes of each pixel and a pattern of an arrangement of the sub-pixel electrodes. In this embodiment, 4 bits-16 retardations display is adopted. If the area of sub-pixel electrode P0 is "1", the area of sub-pixel electrode P1 is double, P2 is four times and P3 is eight times. The 4 bits image data input to corresponding SRAM circuits 10 is converted to respective write-in voltages and supplied to respective sub-pixel electrodes P0~P3.

According to the present invention, the pixel PX includes a SRAM circuit formed of a first inverter circuit 11 and a clocked inverter circuit 12, a polarity inversion switching circuit 13 and a second inverter circuit 14, and a switch 15 to prevent a display time lag is provided at an end portion of the signal line S to connect the signal line S to the inverted common voltage. The write-in operation or holding operation of image data is conducted by the control signals Gate, GateB, PolA and PolB.

The liquid crystal display device having the above construction can provide many advantages.

The alternation of the voltage supplied to the liquid crystal layer is practiced by the polarity inversion switching circuit and the polarity control signals PolA and PolB. Therefore, it is not required to alternate the voltages "H" level (VLCH) and "L" level (VLCL) supplied to the liquid crystal layer, which results in reduction in an AC current consumption of the signal line driving circuit 6. That is, the signal driving circuit 6 inverts the signal data in positive and negative polarities in a cycle of the alternation of the liquid crystal layer in a conventional liquid crystal display device. Therefore, a large AC power consumption is accompanied when all the signal line loads are simultaneously swung.

According to the present invention, it is possible to alternate the voltages applied to the liquid crystal layer without inverting the signal voltage. Therefore, even in a display in which the image data is rewritten sequentially, it is possible to make the power consumption remarkably small without impairing the display quality.

When the pixel images for a moving image display are sequentially rewritten, the polarity inversion of the pixel is made by the polarity inversion switching circuit 13. Therefore, the polarity of the output signal of the signal line driving circuit 6 may be constant regardless the polarities of the frame. Accordingly, it becomes possible to remarkably simplify the circuit construction and to suppress AC current consumption in the signal driving circuit 6.

Furthermore, the loads of the control signals (PolA, PolB) are small and the alternation of the control signals (PolA, PolB) may be made using low cycles such that a flicker phenomenon is not detected. Therefore, it is possible to make the driving ability of the scan line driving circuit 5 small, which enables to manufacture driving circuits 5 and 6 using the same process as the pixel PX and to integrate driving circuits 5 and 6 in a small size array substrate.

Furthermore, when the power becomes on state, off state or decreases abruptly, the switch to prevent a display time lag is made "ON" state, and a path to set the level of the stored charges in the pixel electrode at the same level as the counter electrode (VCOM) is formed. Accordingly, the non-uniformity of display by a display time lag is prevented by discharging the charges stored in the pixel electrode instantaneously.

The present invention is not limited directly to the above described embodiments. In practice, the structural elements can be modified without departing from the spirit of the invention. Various inventions can be made by properly combining the structural elements disclosed in the embodiments. For example, some structural elements may be omitted from all the structural elements disclosed in the embodiments. Furthermore, structural elements in different embodiments may properly be combined. It is to therefore be understand that within the scope of the appended claims, the present invention may be practiced other than as specifically disclosed herein.

What is claimed is:

1. A liquid crystal display device, comprising:

a pair of substrates including electrodes formed on the respective substrates;

a liquid crystal layer interposed between the pair of substrates;

a plurality of pixels arranged in a matrix on the substrates;

signal lines arranged in a column direction on one of the substrates, each of signal lines connected to the pixels arranged in the column direction to supply bit signals corresponding to an image signal;

control lines arranged in a row direction, the control lines selecting pixels arranged in the row direction to supply a plurality of control signals to write and hold the bit signals corresponding to the image signal to the selected pixels; and each pixel comprising, a static memory to hold the bit signals, a switch element to take in the bit signals corresponding to the image signal to the static memory, a polarity control circuit to control the held bit signals, and a driving voltage generator to supply voltages generated by the bit signals to the liquid crystal layer, wherein the transmittance of the liquid crystal layer is changed corresponding to the bit signals, and wherein the liquid crystal display device further comprises an inverter to invert a common voltage, and a switch to control a supply of the inverted common voltage to the signal line to prevent a display time lag when the liquid crystal display device becomes power on or off, and the power abruptly decreases.

2. The liquid crystal display device according to the claim 1, wherein:

the control lines supply first and second gate signals to the pixels, and the switch element switches the supply of bit signals from the signal line to the static memory, and the static memory includes a first inverter to invert the written bit signals, and a clocked inverter driven by the first and second gate signals to receive the inverted bit signals, and an input terminal of the first inverter circuit and an output terminal of the clocked inverter circuit are connected.

3. The liquid crystal display device according to the claim 2, wherein the control lines supply first and second polarity control signals having opposite polarities to the pixels, and the polarity control circuit selects one of the output signals of the first inverter circuit and the clocked inverter circuit.

4. The liquid crystal display device according to the claim 3, wherein the driving voltage generator includes a buffer circuit to supply voltages to the liquid crystal layer by alternating the polarities of the first and second polarity control signals in each frame of image signal.

5. The liquid crystal display device according to the claim 4, wherein the buffer circuit includes a second inverter to invert the output of the polarity control circuit.

6. The liquid crystal display device according to the claim 4, wherein the static memory and the buffer circuit are formed of P channel and N channel transistors.

7. A method for controlling a liquid crystal display device including a pair of substrates, a liquid crystal layer held therebetween, a plurality of pixels arranged in a matrix and a static memory formed on the substrates, comprising:

supplying a bit signal corresponding to an image data to a signal line and writing and holding the bit signal in the static memory in each pixel;

controlling the polarity of the bit signal;

generating a liquid crystal voltage supplied to the liquid crystal layer by the bit signal, and alternating the liquid crystal voltage based on the controlled polarity of the bit signal;

changing a transmittance of the liquid crystal layer by supplying the liquid crystal voltage, inverting a common voltage; and controlling a supply of the inverted common voltage to the signal line to prevent a display time lag when the liquid crystal display device becomes power on or off, and the power abruptly decreases.

8. A liquid crystal display device, comprising:

a counter substrate and an array substrate including electrodes formed on the respective substrates;

a liquid crystal layer interposed therebetween;

a plurality of pixels arranged in a matrix on the substrates;

signal lines arranged in a column direction and connected to the pixels arranged in the column direction to supply a bit signal corresponding to an image signal; and control lines arranged in a row direction and connected to the pixels, the control lines selecting pixels arranged in the row direction to write and hold bit signals corresponding to image data in selected pixels, and wherein each of the pixels includes, a pair of gate lines, first and second power source lines, first and second polarity control lines, a static memory including a first inverter circuit formed of P channel and N channel transistors with a first input node and a first output node, a clocked inverter circuit formed of an inverter circuit and a pair of first transistors connected between the inverter circuit and the first and second power source lines, respectively, the clocked inverter circuit formed of P channel and N channel transistors and having a second output node connected to the first input node, a switching transistor connected between the signal line and the first input node to control a write operation of the bit signal corresponding to the image data, and a polarity control circuit formed of a pair of second transistors to alternate the voltages supplied to a pixel electrode, in which complementary polarity control signals are supplied to gate electrodes of the second transistors respectively, respective source electrodes of the second transistors are connected to the first output node and the second output node and drain electrodes of the second transistors are commonly connected to a pixel electrode through a third output node, wherein the transmittance of the liquid crystal layer is changed corresponding to the bit signals, and wherein the liquid crystal display device further includes:

an inverter to invert a common voltage and a switching transistor to control a supply of the inverted common voltage to the signal line to prevent a display time lag when the liquid crystal display device is powered on or off, and/or power is abruptly reduced.

9. The liquid crystal display device according to claim 8, further comprising:

a second inverter circuit connected between the third output node and the pixel electrode.

10. The liquid crystal display device according to claim 8, wherein the switching transistor and the transistors forming the polarity control circuit are formed of a transfer gate composed of P channel and N channel transistors.

11. The liquid crystal display device according to the claim 8, further comprising:

a reset control line connected between a control circuit and a switching transistor to control a switching operation of the switching transistor.

* * * * *